US006079886A

United States Patent [19]

Kameyama

[11] Patent Number: 6,079,886

[45] **Date of Patent: *Jun. 27, 2000**

[54] RIBBON CASSETTE HAVING LEVERAGED MOVEMENT DURING INSTALLATION OR EJECTION FROM PRINTING APPARATUS

[75] Inventor: Yoshikatsu Kameyama, Gifu-ken, Japan

[73] Assignee: Brother Kogyo Kabushiki Kaisha, Nagoya, Japan

[ * ] Notice: This patent is subject to a terminal disclaimer.

[21] Appl. No.: 09/339,839

[22] Filed: Jun. 25, 1999

Related U.S. Application Data

[63] Continuation of application No. 08/998,668, Dec. 29, 1997, Pat. No. 5,984,546.

[30] Foreign Application Priority Data

Jan. 7, 1997 [JP] Japan ..... 9-952

[51] Int. Cl.[7] ..... B41J 35/28

[52] U.S. Cl. ..... 400/208; 400/207

[58] Field of Search ..... 400/207, 208, 400/208.1, 224.2, 246

[56] References Cited

U.S. PATENT DOCUMENTS

| | | | |
|---|---|---|---|
| Re. 34,521 | 1/1994 | Shimizu et al. | 400/208 |
| D. 383,743 | 9/1997 | Suwa et al. | D14/118 |
| 4,973,983 | 11/1990 | Yamamoto et al. | 400/208 |
| 5,352,048 | 10/1994 | Mizoguchi et al. | 400/208 |
| 5,415,486 | 5/1995 | Wouters et al. | 400/207 |
| 5,480,242 | 1/1996 | Gunderson | 400/208 |
| 5,547,298 | 8/1996 | Wouters et al. | 400/207 |
| 5,584,587 | 12/1996 | Koike et al. | 400/207 |
| 5,795,083 | 8/1998 | Gallagher | 400/207 |

FOREIGN PATENT DOCUMENTS

| | | |
|---|---|---|
| 0 381 154 A2 | 8/1990 | European Pat. Off. . |
| 0 466 194 A2 | 1/1992 | European Pat. Off. . |
| 7-283919 | 10/1995 | Japan . |

OTHER PUBLICATIONS

Photographs of a ribbon cassette sold in Jul., 1995.

Brother's PC–101 Ribbon Cassette, commercially available: Jul., 1995.

*Primary Examiner*—John S. Hilten
*Assistant Examiner*—Leslie J. Grohusky
*Attorney, Agent, or Firm*—Oliff & Berridge, PLC

[57] ABSTRACT

A ribbon cassette is easily loaded without allowing a torsion force to be acted when the cassette is loaded into a printing apparatus and/or a facsimile apparatus each using the ribbon cassette. A ribbon cassette has a ribbon supplying part for supplying an ink ribbon, a ribbon take-up part for taking up the ink ribbon which is led from the ribbon supplying part and passed between a print head and a platen roller, and connecting parts for connecting the supplying and take-up parts. The connecting parts are provided with projecting holding parts for attachment or detachment, and the holding parts are positioned near the ribbon take-up part positioning on the side remote from a hinge member.

19 Claims, 13 Drawing Sheets

RIBBON CASSETTE HAVING LEVERAGED MOVEMENT DURING INSTALLATION OR EJECTION FROM PRINTING APPARATUS

This is a Continuation of application Ser. No. 08/998,668 filed Dec. 29, 1997 now U.S. Pat. No. 5,984,546. The entire disclosure of the prior application is hereby incorporated by reference herein in its entirety.

BACKGROUND OF THE INVENTION

1. Field of the Invention

The present invention relates to a ribbon cassette, and a printing apparatus and a facsimile apparatus each using the same.

2. Description of Related Art

Hitherto, it is known that in a printing apparatus used for a facsimile apparatus or the like, a ribbon cassette in which an ink ribbon is housed in a cassette case is used in order to make replacement of the ink ribbon for printing easy (refer to JP-A-7-283919).

The ribbon cassette has a cylindrical ribbon supplying part for supplying an ink ribbon, a cylindrical ribbon take-up part for taking up the ink ribbon, and a connecting arm for connecting both of the parts. Printing is performed by a print head in a position while the ink ribbon is moved from the ribbon supplying part to the ribbon take-up part.

As shown in FIGS. 11 and 12 casing 100A of such a ribbon cassette 100 is constructed by: main body parts 101A, 102A in which a ribbon supplying part 101 and a ribbon take-up part 102 are connected to connecting arms 103, 103; and lid members 101B, 102B which are connected to the main body parts 101A, 102A openably and closably. The ribbon supplying part 101A houses a supply roll 117 around which an ink ribbon 116 is wound. The ribbon take-up part 102A houses a take-up roll 118 for taking up the ink ribbon 116 supplied from the supply roll 117.

Further, in order to prevent the lid members 101B, 102B from being opened arbitrarily at the time of operation, the lid members 101B, 102B are provided with engaged parts 104, 104, 104, 104 and the main body parts 101A, 102A are provided with engagement parts 105, 105, 105, 105 which are detachably engaged with the engaged parts 104.

As shown in FIG. 11, the ink ribbon 116 is arranged so as to pass the inner sides of the engagement parts 105. The length h1 in the axial direction of the ribbon cassette 100 is longer than the width h2 of the ink ribbon 116.

The ribbon cassette 100 is loaded into a facsimile apparatus as follows. First, as shown in FIG. 13A, a lid member 111 is opened, two levers 113 on a main body casing 112 side are lifted to stand a print head 114. Then, as shown in FIG. 13B, the ink ribbon is tightened by rotating a ribbon roll (not shown) or the like so that the ink ribbon is in a tensed state. As shown in FIG. 13C, the ribbon cassette 100 is held and inserted by using an arrow 115 as a guide, and as shown in FIG. 13D, the ribbon cassette 100 is loaded into a predetermined position in the main body casing 112. Subsequently, as shown in FIG. 13E, a procedure for laying the print head 114 and closing the lid member 111 is performed.

According to the above-mentioned structure, however, the casing 100A of the ribbon cassette 100 has a shape in which the ribbon supplying part 101 and the ribbon take-up part 102 are connected by the elongated connecting arms 103 and which tends to be twisted and deformed. Consequently, when the ribbon cassette 100 is loaded into the main body casing 112 torsion force consequently acts on the ribbon cassette 100 depending on the way of holding the ribbon cassette 100, the ribbon cassette 100 is twisted and deformed. There is a possibility that the engagement between the engaged parts 104, 104 and the engagement parts 105, 105 is cancelled, the lid member 111 is opened, and the ink ribbon 116 is exposed. There is also a request that the ribbon cassette 100 is loaded as simple as possible.

SUMMARY OF THE INVENTION

In consideration of the above points, it is an object of the present invention to provide a ribbon cassette which can be easily loaded without being acted on by a torsion force when the cassette is loaded, and a printing apparatus and a facsimile apparatus each using the ribbon cassette.

In order to achieve the object, according to a first aspect of the present invention, there is provided a ribbon cassette having a ribbon supplying part for supplying an ink ribbon, a ribbon take-up part for taking up the ink ribbon, and a connecting part for connecting both of the parts. The connecting part is provided with projecting holding parts.

Accordingly, by holding the holding parts, the cassette can be easily attached or detached without creating a torsion force.

The holding parts may be positioned near the ribbon supplying part or the ribbon take-up part. Consequently, since the cassette is attached or detached by holding the holding parts positioning near the ribbon supplying part or the ribbon take-up part which is relatively heavy, the operation can be stably performed.

According to a second aspect, a printing apparatus comprises a main body casing having an opening in which a recording head is provided; and a lid member for closing the opening of the main body casing. The ribbon cassette according to the first aspect is detachably attached in the main body casing through the opening in correspondence to the recording head.

Consequently, by holding the holding parts, without allowing the torsion force to be acted on the ribbon cassette, the cassette can be easily attached or detached to/from the printing apparatus.

The lid member may be connected to the main body casing via a hinge member, thereby closing the opening of the main body casing. The holding parts are arranged near the ribbon supplying part or the ribbon take-up part positioning on the side far from the hinge member.

Consequently, since the holding parts are arranged near the ribbon supplying part or the ribbon take-up part positioned on the side far from the hinge member, by simply holding the holding parts, the cassette can be easily attached or detached to/from the main body casing irrespective of the opening state of the lid member.

In embodiments, an engaged part may be provided near the hinge member of the main body casing and has first and second engaged faces; and an engagement part may be provided near the ribbon take-up part or the ribbon supplying part positioning on the side near the hinge member and has a first engagement face which comes into contact with the first engaged face of the engaged part when the ribbon cassette is ejected, thereby forming the rotation center for cassette ejection.

Consequently, by holding and lifting the holding parts, the rotation center for cassette ejection is formed by the engagement relation between the first engaged face on the main body casing side and the first engagement face of the engagement part of the ribbon cassette, the cassette can be ejected not forcedly.

The engagement part may have a second engagement face which comes into contact with the second engaged face of the engaged part subsequent to the first engagement face, thereby forming another rotation center for cassette ejection when the ribbon cassette is ejected.

Consequently, even in a case where rotation with respect to the rotation center for cassette ejection formed by the engagement relation between the first engaged face on the main body casing side and the first engagement face of the engagement part of the ribbon cassette is insufficient, rotation around another rotation center for cassette ejection formed by the engagement relation between the second engaged face on the main body casing side and the first engagement face of the engagement part of the ribbon cassette is further performed, so that the ribbon cassette can be certainly ejected.

According to a third aspect of the present invention, there is provided a facsimile apparatus comprising a reception buffer for storing received reception image information and recording structure including a recording head including a plurality of heater elements arranged in a line and for recording the reception image information onto a recording medium every predetermined lines via an ink ribbon having the width which is almost equal to a recording area width of the recording head, wherein the printing apparatus according to the second aspect of the invention is used as the recording structure.

Accordingly, in the facsimile apparatus, the ribbon cassette used as the recording structure can be attached or detached without undue force.

According to the first aspect of the invention, since the connecting part for connecting the ribbon supplying part for supplying the ink ribbon and the ribbon take-up part for taking up the ink ribbon are provided with holding parts projectingly, by holding the holding parts, the cassette can be easily attached or detached.

Since the holding parts are provided near the ribbon supplying part or the ribbon take-up part, the cassette is attached or detached by holding the holding parts positioning near the ribbon supplying part or the ribbon take-up part which is relatively heavy. Thus, the operations can be stably performed.

According to the second aspect of the invention, in a printing apparatus, by holding the holding parts in a manner similar to the first aspect of the invention, the cassette can be easily attached or detached.

Since the holding parts are arranged near the ribbon supplying part or the ribbon take-up part positioned on the side far from the hinge member, the cassette can be attached or detached to/from the printing apparatus by holding the holding parts irrespective of the opening state of the lid member.

By holding and lifting the holding parts, the rotation center for cassette ejection is formed by the engagement relation between the first engaged face of the engaged part on the main body casing side and the first engagement face of the engagement part of the ribbon cassette, the cassette can be easily ejected.

Since another rotation center for cassette ejection is formed by the engagement relation between the second engaged face of the engaged part on the main body casing side and the second engagement face of the engagement part on the ribbon cassette side, even in a case where the rotation with respect to the rotation center for cassette ejection formed by the engagement relation between the first engaged face on the main body casing side and the first engagement face of the engagement part on the ribbon cassette side is insufficient, the rotation around another rotation center for cassette ejection is performed and the ribbon cassette can be certainly ejected.

According to the third aspect of the invention, in a facsimile apparatus, since the printing apparatus according to the second aspect of the invention is used as the recording structure, the ribbon cassette of a print part in the facsimile apparatus can be easily attached or detached.

BRIEF DESCRIPTION OF THE DRAWINGS

These and other aspects and advantages of the invention will become apparent from the following detailed description of preferred embodiments when taken in conjunction with the accompanying drawings, in which.

DETAILED DESCRIPTION OF PREFERRED EMBODIMENTS

An embodiment of the invention will be described hereinbelow with reference to drawings.

Figure 1:
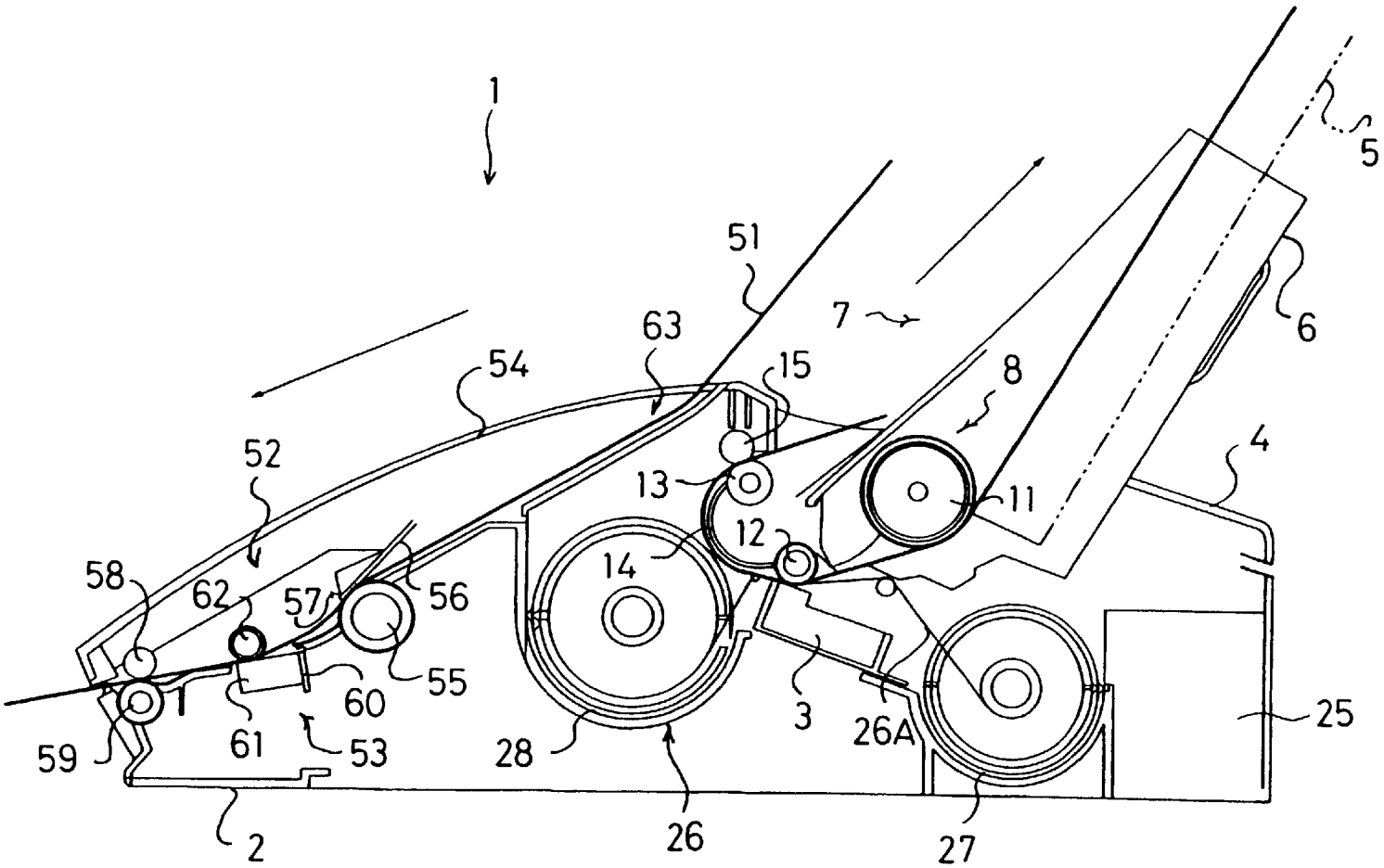
FIG. 1 is a central longitudinal section showing the internal structure of a facsimile apparatus according to the invention.

FIG. 1 shows the internal structure of a facsimile apparatus according to the invention. A facsimile apparatus 1 has a main body casing 2 having an opening 2A (refer to FIG. 3) in which a print head 3 is arranged in the opening 2A and a lid member 4 for closing the opening 2A of the main body casing 2 openably and closably.

In the lid member 4, a recording medium housing part 6 for housing a number of recording papers 5 in a stacked state and a recording medium conveying unit 8 for taking out the recording paper 5 from the recording medium housing part 6 and conveying it via the print head 3 to an ejecting part 7 as a space part above the lid member 4, for ejecting the printed recording paper 5 are integrally formed.

The recording medium conveying unit 8 of the lid member 3 has a paper feeding roller 11 for feeding the recording paper 5 from the recording medium housing part 6 one by one, a platen roller 12 provided opposite to the print head 3 on the main body casing 2 side, and an ejection roller 13 for ejecting the recording paper 5 to the ejection part 7 above the lid member 4. These rollers 11, 12 and 13 are sequentially arranged from the upstream side of the conveying direction. For smooth conveyance of the recording papers 5, the recording medium conveying unit 8 has also a U-shaped paper guide 14 arranged between the platen roller 12 and the ejection roller 13 and a pinch roller 15 provided in correspondence to the ejection roller 13. Although not specifically shown, the rollers 11, 12 and 13 are rotated by a motor for LF (Line Feed) via a gear mechanism.

The recording papers 5 stacked in the recording medium housing part 6 are fed from the recording medium housing part 6 to the platen roller 12 side one by one by the paper feeding roller 11 and an image such as characters, figures, and the like is recorded by the print head 3 via an ink ribbon 26A which will be described later in the position of the platen roller 12. The printed recording paper 5 is guided by the paper guide 14, passed through the pinch roller 15 and the ejection roller 13, and ejected to the ejection part 7 located above the recording medium housing part 6.

The tip of the recording paper 5 fed from the recording medium housing part 6 is detected by a sensor for detecting the recording paper tip (not shown) provided in correspondence to a paper conveyance path in the main body casing 2, and a printing timing by the print head 3 is determined on the basis of the detection signal. The ejecting part 7 also has a recording paper ejection sensor (not shown) for detecting the ejection of the recording paper 5. When a plurality of sheets of paper are continuously recorded (printed) and the recording paper ejection sensor detects that the recording paper 5 on which the image is recorded is completely ejected, the next recording paper 5 is fed from the recording medium housing part 6 by the paper feeding roller 11. With such control, paper jam is avoided.

Figure 2:
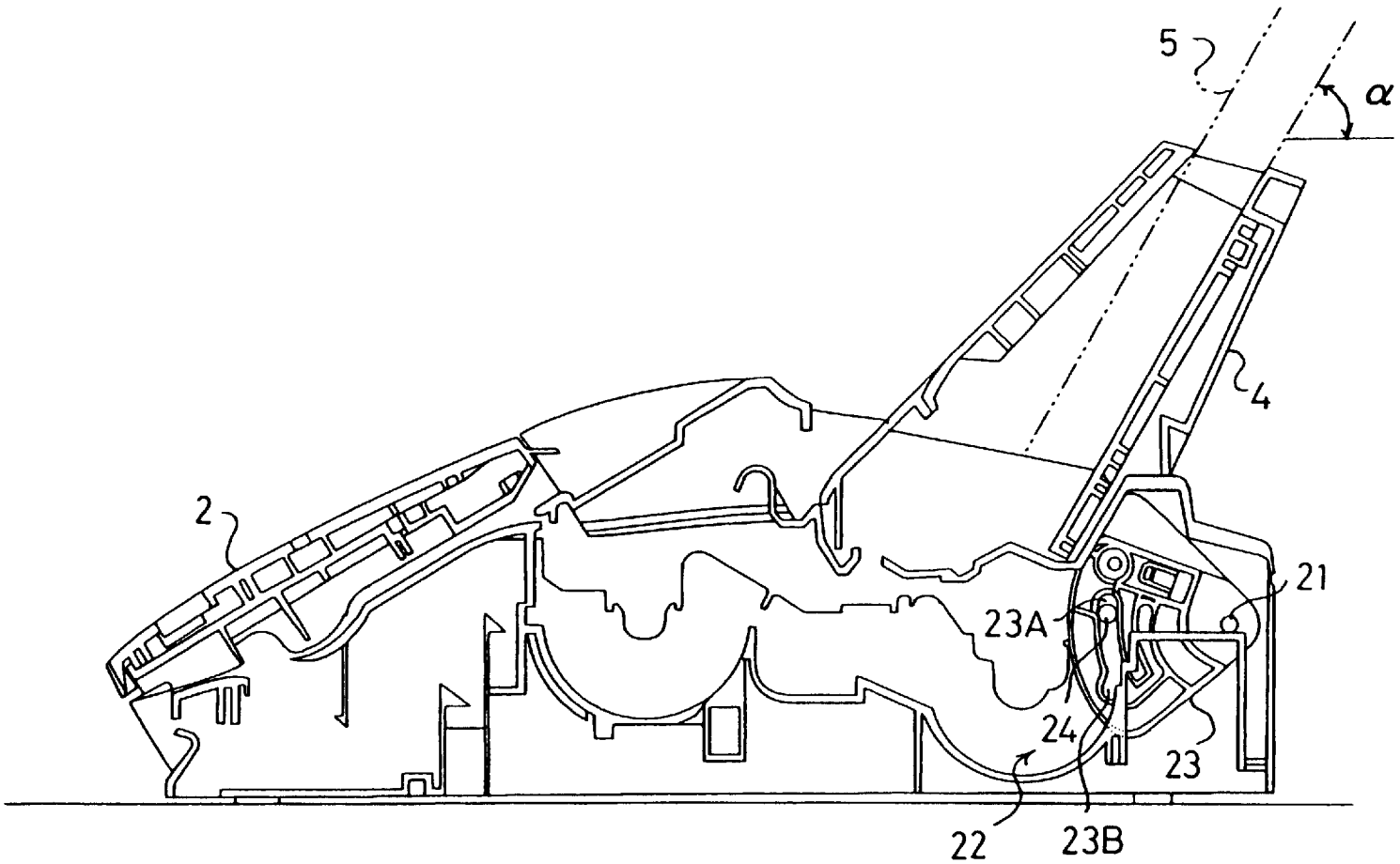
FIG. 2 is a central longitudinal section showing the relation between a main body casing and a lid member of the facsimile apparatus.
Figure 3:
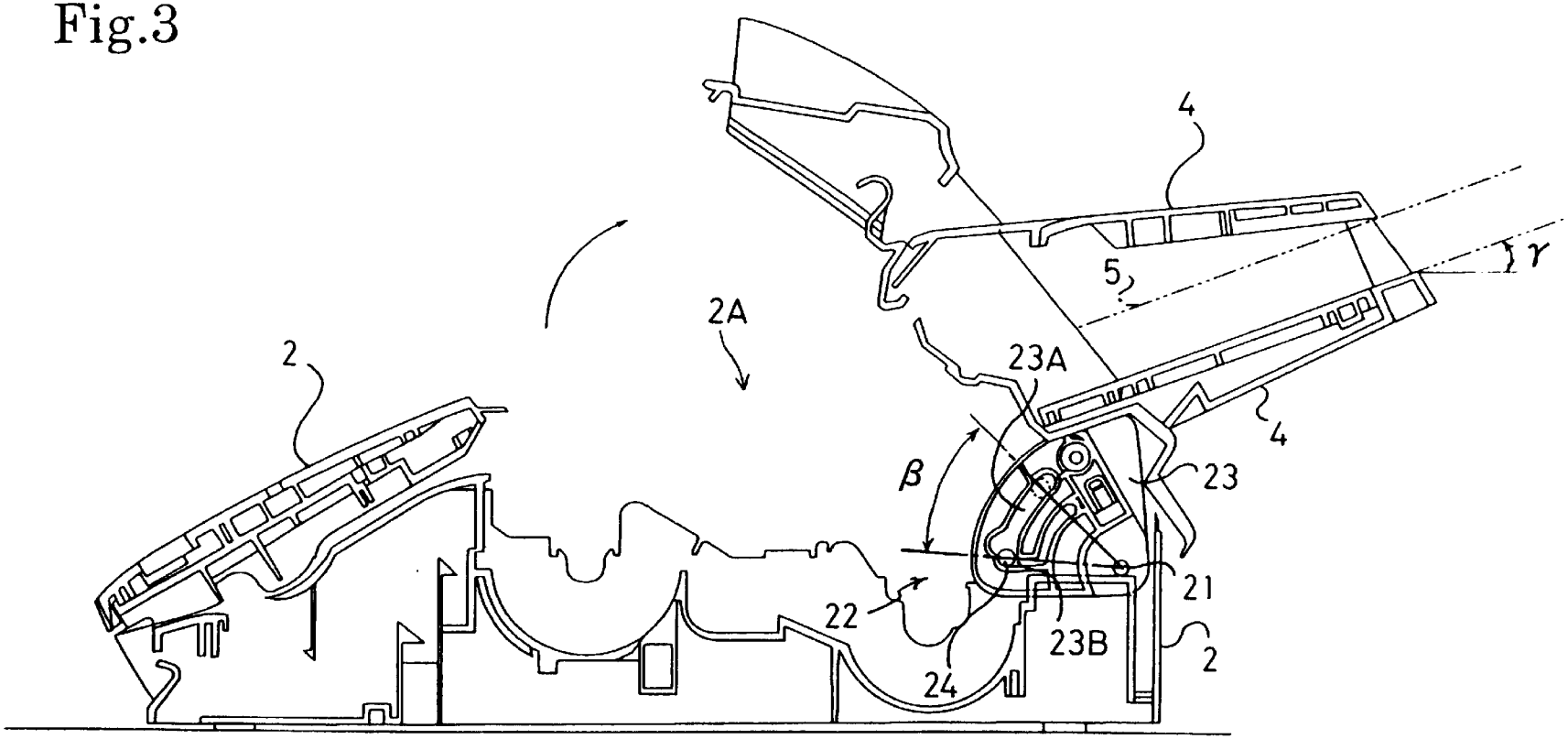
FIG. 3 is a central longitudinal section showing the state where the lid member of the facsimile apparatus is opened.
Figure 4:
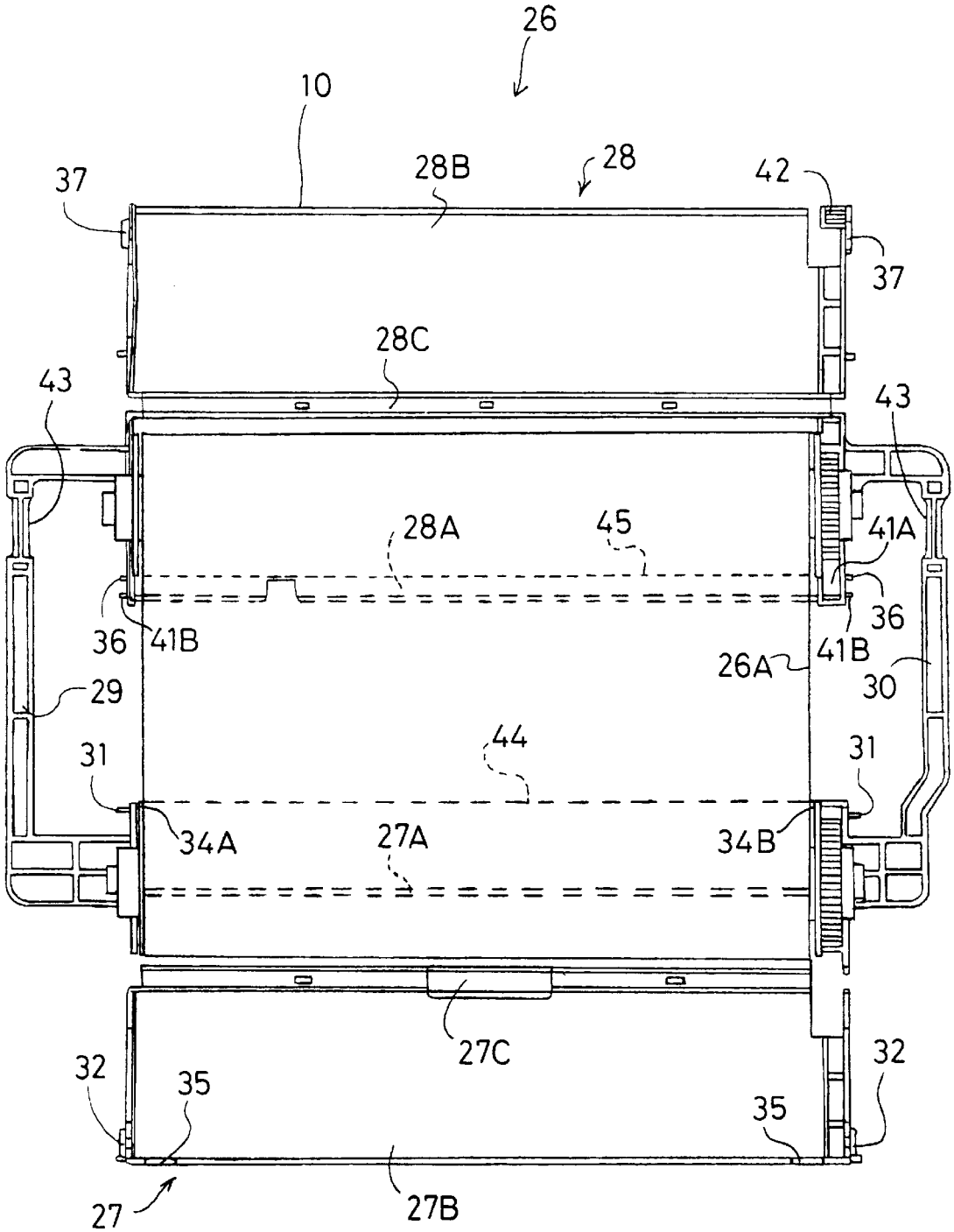
FIG. 4 is a plan view of a state where a ribbon supplying part and a ribbon take-up part of a ribbon cassette are opened.
Figure 5:
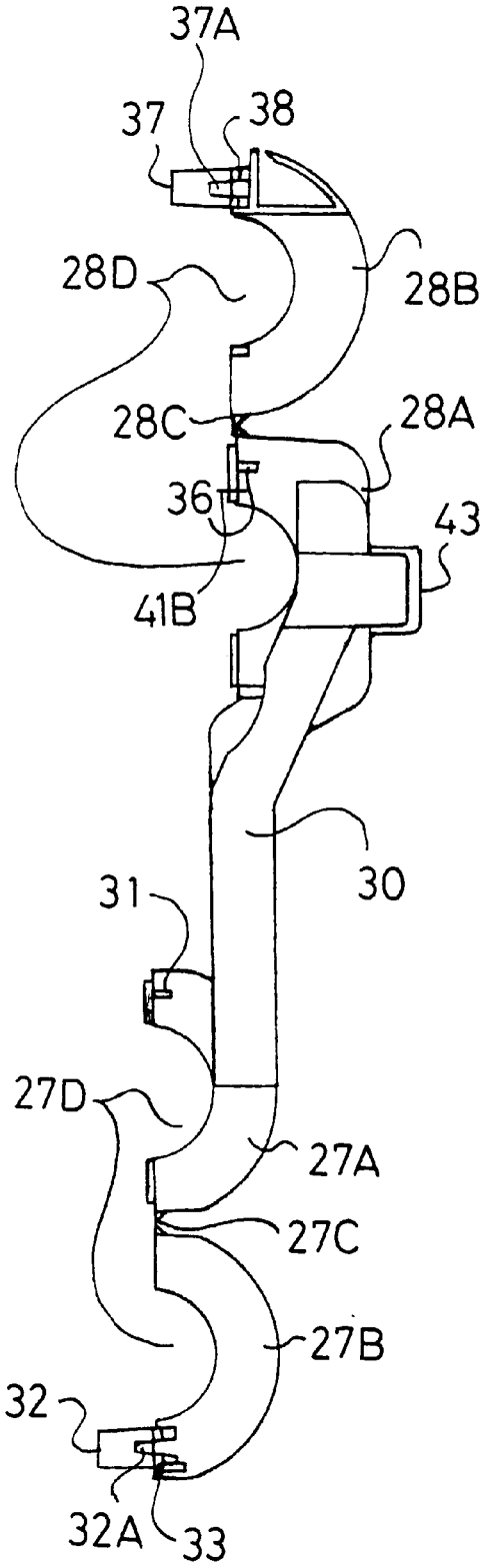
FIG. 5 is a right side elevational view of the same.
Figure 6:
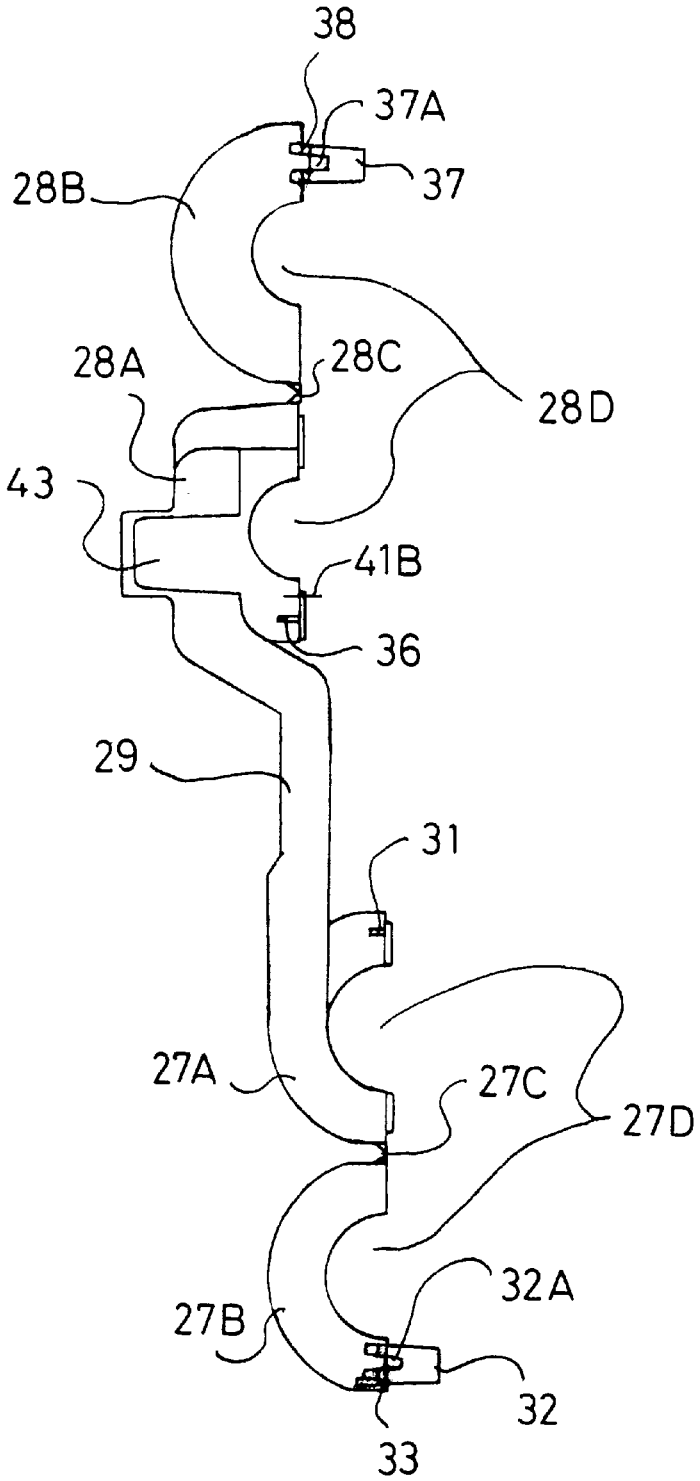
FIG. 6 is a left side elevational view of the same.
Figure 7:
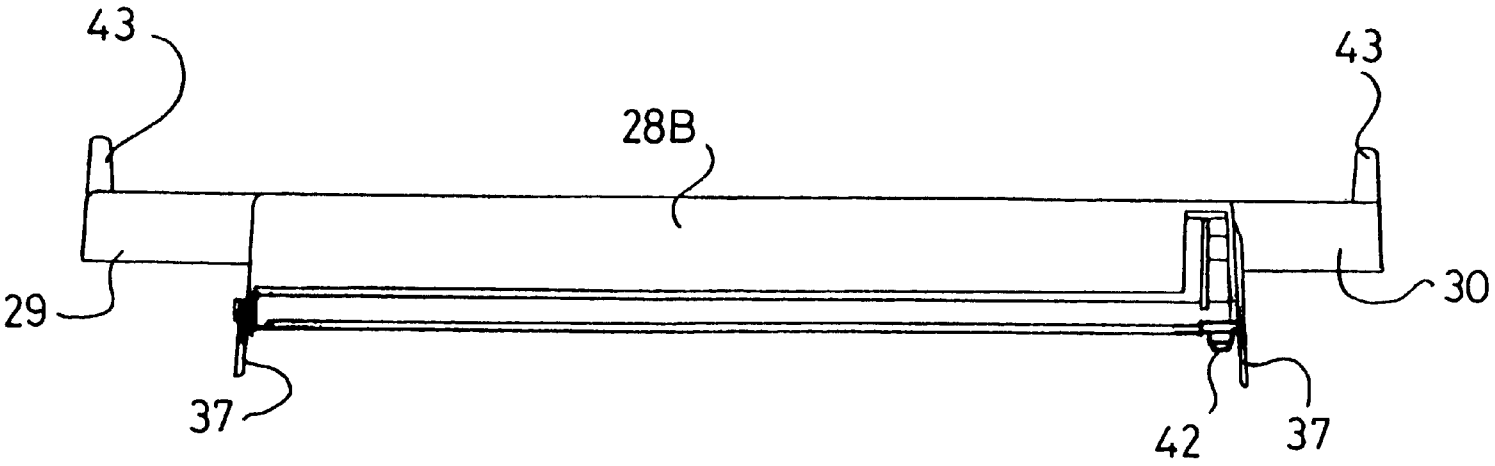
FIG. 7 is a plan view of the same.
Figure 8:
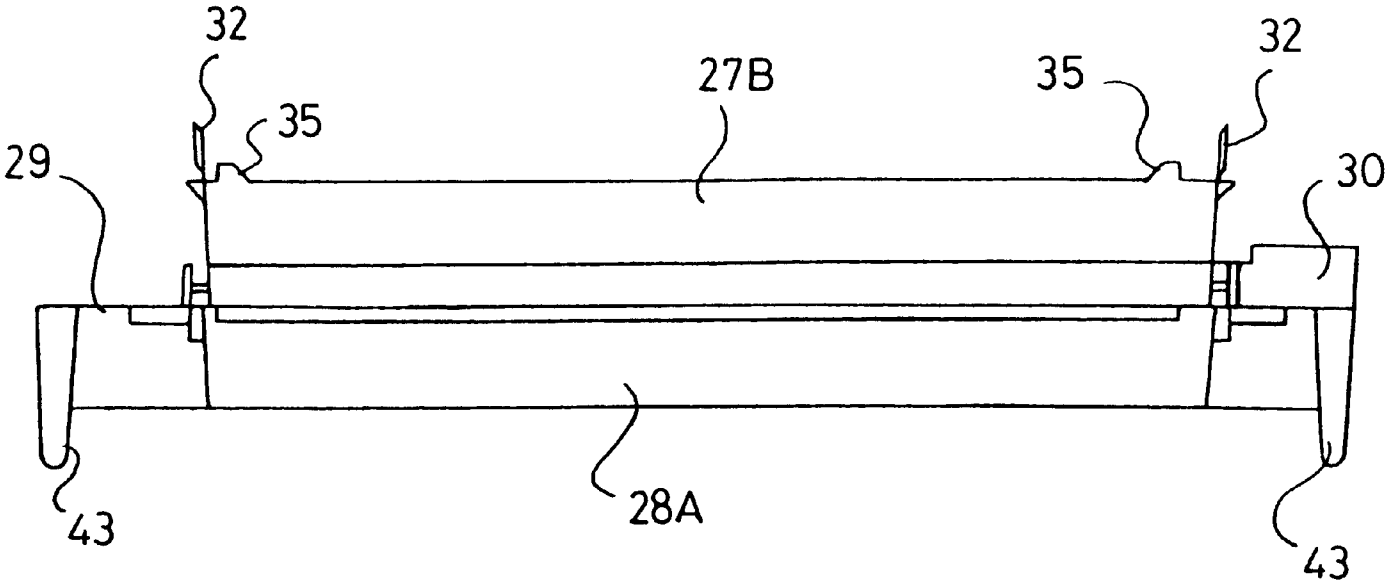
FIG. 8 is a bottom view of the same.

As shown in FIGS. 2 and 3, the lid member 4 is rotatably supported by the main body casing 2 around a rotation axis 21 as a rotation center. Further, the rotation angle of the lid member 4 with respect to the main body casing 2 is regulated by regulating means 22 in a predetermined range so that the recording paper 5 is not dropped from the recording medium housing part 6. The lid member 4 has a hinge member 23 that is rotatably supported by the main body casing 2 around the rotation axis 21.

Specifically, the regulating means 22 for regulating the rotational angle of the lid member 4 in a predetermined angle range has a guide hole 23A which is a circular arc shaped long hole opened in the hinge member 23 of the lid member 4 and an engagement pin member 24 which is movably engaged with the guide hole 23A opened on the main body casing 2 side.

In a state where the lid member 4 is closed, as shown in FIG. 2, the recording paper 5 and the horizontal plane has an angle $\alpha$ of about 60° so that the recording paper 5 is smoothly supplied. When the lid member 4 is opened, as shown in FIG. 3, the lid member 4 is turned by an angle $\beta$ of about 40° around the rotation axis 21 while the opening operation of the lid member 4 is guided by the engagement relation between the guide hole 23A of the hinge member 23 and the engagement pin member 24 which form the regulating means 22. Although the recording paper 5 and the horizontal plane has accordingly an angle $\gamma$ of about 20°, the further rotation of the lid member 4 is regulated and the lid member 4 is not opened more than that.

That is, the rotation angle of the lid member 4 with respect to the main body casing 2 for the horizontal plane is regulated within a range from 0° to about 40° by the regulating means 22 constructed by the guide hole 23A of the hinge member 23 and the engagement pin member 24. As a result of the regulation, the range of angle change of the recording medium housing part 6 for housing the recording paper 5 with respect to the horizontal plane is set in a range from about 60° to about 20°. Even in a state where the recording medium housing part 6 is closest to the horizontal state, the angle between the recording paper 5 and the horizontal plane is about 20°, so that the recording paper 5 is not dropped from the recording member housing part 6. The guide hole 23A has an engagement hole 23B. By engaging the engagement pin member 24 with the engagement hole 23B, the turn angle of the lid member 4 for the main body casing 2 with respect to the horizontal plane is maintained to the angle of about 40° (the maximum angle at which the recording paper 5 is not dropped from the recording medium housing part 6). Consequently, various works to the inside of the main body casing 2 can be performed while holding the lid member 4 in the most-widely opened state. It can be prevented that the lid member 4 is abruptly closed when such works are performed and the works are disturbed to be performed smoothly.

In addition to the print head 3, the main body casing 2 also comprises: control means 25 which has a reception buffer (not shown) for temporarily storing reception image information received via a communication line and controls the printing by the print head 3 on the basis of the reception image information; and a ribbon cassette 26 which houses the ink ribbon 26A having the width almost the same as the recording area width of the print head 3 for printing by the print head 3 and is set in a predetermined position in the opening 2A. Although not specifically shown, the control means 25 is constructed by a microcomputer including a CPU, a ROM, and a RAM, and the RAM has the above-mentioned reception buffer.

The print head 3 is constructed by a thermal head having a number of heater elements arranged in a line in the direction perpendicularly crossing the feeding direction of the recording paper 5. The number of heater elements is selectively heated based on signals (reception image information) supplied to the control means 25, the printing is performed onto the recording paper 5 via the ink ribbon 26A in the ribbon cassette 26, and an image of characters, figures, and the like is recorded.

Although not specifically shown, the main body casing 2 also has an operation panel having a liquid crystal display, a keyboard, and the like for executing various operations.

In the ribbon cassette 26, the ink ribbon 26A is housed in a casing 10 integrally made of polypropylene. The details are as shown in FIGS. 4 to 8. The ribbon cassette 26 has a ribbon supplying part 27 for supplying the ink ribbon 26A, a ribbon take-up part 28 for taking up the ink ribbon 26A led from the ribbon supplying part 27 and passed between the print head 3 and the platen roller 12 and connecting parts 29 and 30 for connecting the parts 27 and 28.

The ribbon supplying part 27 has a supply part main body 27A connected to the connecting parts 29, 30 and a lid member 27B openably and closably connected to the supplying part main body 27A along a mating plane via a hinge part 27C (what is called a polypropylene (P.P.) hinge). While retained parts 31, 31 are provided on both of the right and left sides of the supply part main body 27A, retaining parts 32, 32 which detachably come into engagement with the retained parts 31 and retain the lid member 27B by the supply part main body 27A, are provided on both of the right and left side faces of the lid member 27B.

While the retained parts 31 are protrusions projecting sideward, the retaining parts 32 are provided via hinges 33, 33 (so-called P.P. hinges) on the other side faces of the lid member 27B and have engagement holes 32A, 32A with which the protrusions (retained parts 31) are detachably engaged.

The ribbon supplying part 27 has engaged parts 34A, 34B provided near the retained parts 31, and engagement projecting parts 35, 35 which are provided near the retaining parts 32, detachably engaged with the engaged parts 34A, 34B, and construct the engagement relation countering the force acting in the direction of releasing the retaining relation between the retained parts 31 and the retaining parts 32. With respect to the engaged parts 34A, 34B, although the engaged part 34A is formed on the inner wall face of the supply part main body 27A and the other engaged part 34B is formed on the inner wall face of the recessed part, they can also have the same shape.

Further, in a manner similar to the ribbon supplying part 27, the ribbon take-up part 28 has a take-up part main body 28A connected to the connecting parts 29, 30, and a lid member 28B openably and closably connected to the take-up part main body 28A along a mating plane via a hinge part 28C (so-called P.P. hinge). While retained parts 36, 36 are provided on both of the right and left side faces of the take-up part main body 28A, retaining parts 37, 37 which are detachably engaged with the retained parts 36 and retain the lid member 28B by the take-up part main body 28A are provided on both of the right and left side faces of the lid member 28B.

While the retained parts 36 are protrusions projecting sideward, the retaining parts 37 are provided on the side faces of the lid member 28B via hinge members 38, 38 and have engagement holes 37A, 37A with which the protrusions are detachably engaged. The ribbon take-up part 28 has an engagement recessed part 41A as an engaged part provided near the retained part 36, a projecting part 41B formed on a side of the take-up part main body 28A; and an engagement projecting part 42 which is provided near the retaining part 37, detachably engaged with the engagement recessed part 41A, and constructs the engagement relation countering the force acting in the direction of canceling the retaining relation of the retained part 36 and the retaining part 37. In this example, since the engaged part is the engagement recessed part 41A and the strong engagement relation is constructed with the engagement projecting part 42, the engagement relation between the engaged part and the engagement projecting part is formed only on one side face of the ribbon take-up part 28. However, similar engagement structures can be also provided on both of the right and left sides. In this case, in a manner similar to the ribbon supplying part 27, engagement structures which are different with respect to the right and left can be also constructed.

The connecting parts 29, 30 are provided with rectangular holding parts 43, 43 projectingly. The holding parts 43 are positioned near the ribbon take-up part 28 located on the side far from the hinge member 23 although the holding part 43 has a rectangular shape, the shape is not limited to it. It is needless to say that various shapes can be used in consideration of function, layout, and the like.

Further, in the ribbon supplying part 27 bearings 27D, 27D for rotatably supporting a supply roll 44 for supplying the ink ribbon 26A are formed on the right and left side faces. In the ribbon take-up part 28 bearings 28D, 28D for rotatably supporting a take-up roll 45 for taking up the ink ribbon 26A are formed on the right and left side faces. The take-up roll 45 is rotated in the take-up direction by a motor (not shown) via a gear mechanism. The ink ribbon 26A is line-fed synchronously with the recording paper 5. By feeding the ink ribbon 26A and the recording paper 5 and pressure contacting of the ink ribbon 26A with the recording paper 5 by the print head 3, an image is recorded on the recording paper 5.

Figure 10A:
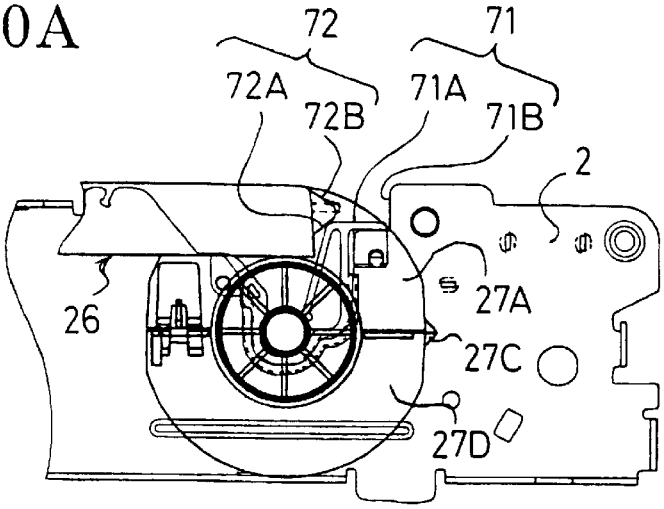
FIGS. 10A–10C are detailed diagrams of the same.

Further, as shown in FIG. 10A, while an engaged part 71 having first and second engaged faces 71A, 71B is provided near the roll bearing part of the supply roll 44 in the ribbon supplying part 27 in the main body casing 2, a mountain-shaped engagement part 72 is provided near the ribbon supplying part 27 locating on the side near the hinge member 23. The engagement part 72 has a first engagement face 72A which comes into contact with the first engaged face 71A, 71B of the engaged part 71 to form the rotation center for ejecting the cassette when the ribbon cassette 26 is ejected. In addition to the first engagement face 72A, the engagement part 72 also has a second engagement face 72B which comes into contact with the second engaged face 71B of the engaged part 71 subsequent to the first engagement face 72A to form another rotation center for ejecting the cassette. The first engaged face 71A of the engaged part 71 extends almost in the horizontal direction and the second engaged face 71B extends almost in the vertical direction continuously from the first engaged face 71B.

As shown in FIG. 1, in the front upper part of the facsimile apparatus 1, an original feeding device 52 for feeding an original 51 at a constant speed and an original reading device 53 for reading an image recorded on the original 51 fed by the original feeding device 52 are arranged. A panel cover 54 positioned on the surface has an operation panel (not shown) for performing various operations regarding facsimile transmission and the like. The operation panel includes a liquid crystal display, a keyboard, and the like.

The original feeding device 52 has a feeding roller 55 for taking the original 51 in, a separating member 56 for separating the originals 51 which come into contact with the feeding roller 55 and are fed one by one, an automatic document feeder (ADF) plate spring 57 for energizing the separating member 56 in the direction so as to come into contact with the feeding roller 55 and a paper ejecting roller 59 for feeding out the original 51 with a roller 58. On the other hand, the original feeding device 53 has a small read sensor 61 (CIS) held in the main body casing 2 via a holder 60 and a white platen roller 62 provided opposite to the read sensor 61.

When the originals 51 to be transmitted are put on an original receiving part 63 which is covered, it is detected by a sensor for detecting original (not shown) and the originals 51 are certainly separated one by one by the separating member 56 and the feeding roller 55 and the original 51 is fed to the original reading position where the read sensor 61 is arranged. The sensor for detecting the original is constructed by two sensors for detecting the presence and absence of the original 51 and also detecting whether the size of the original 51 is B4, A4, or letter sized.

The image recorded on the original 51 is optically read by the read sensor 61 in the original reading position. The read original 51 is fed by the roller 58 and the paper ejecting roller 59 and finally ejected in front of the facsimile apparatus 1.

Figure 9A:
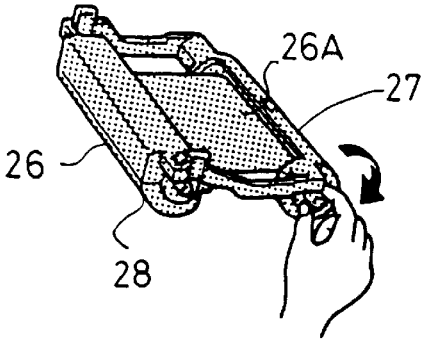
FIGS. 9A–9D are diagrams explaining a procedure for loading a ribbon cassette according to the invention.
Figure 9B:
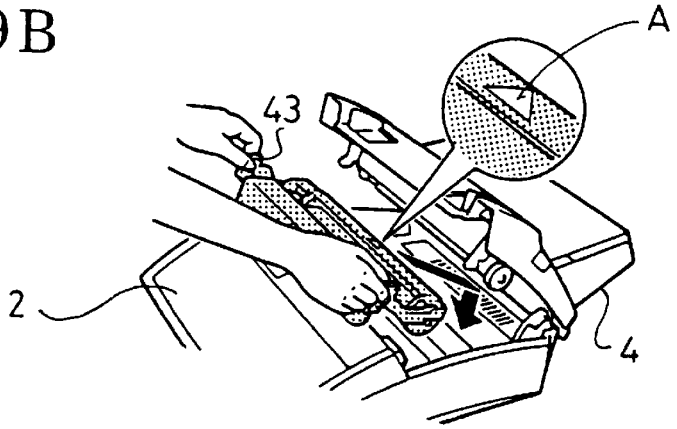
Figure 9C:
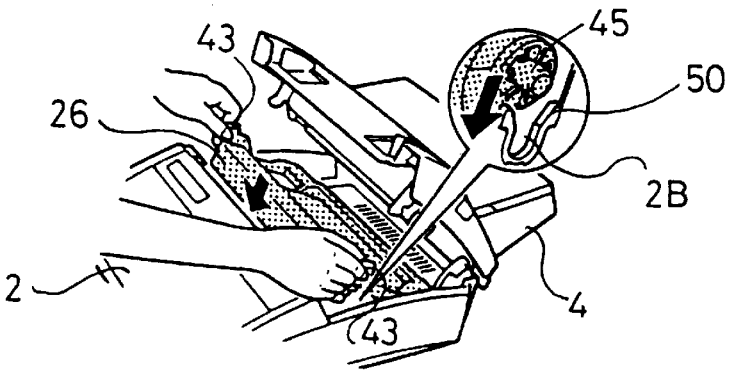
Figure 9D:
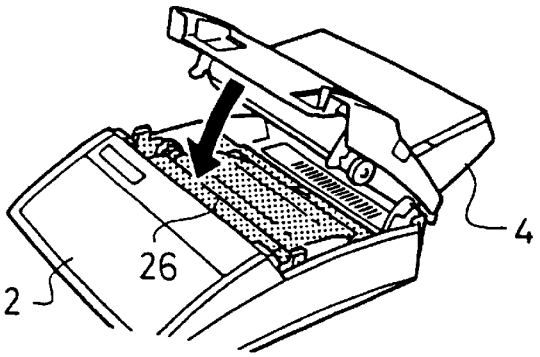

In the facsimile apparatus, therefore, when the ribbon cassette 26 is inserted into the opening 2A of the main body casing 2 as shown in FIG. 9A, the supply roll 44 is rotated first and the ink ribbon is in a tensed state, the holding parts 43, 43 are held and the ribbon cassette 26 is inserted into the main body casing 2 by using the arrow A as a guide as shown in FIG. 9B. Then, as shown in FIG. 9C, while holding the holding parts 43, the ribbon cassette 26 is downwardly displaced and is set in a predetermined position, that is, a position where the shaft of the take-up roll 45 is engaged with the roll bearing 2B, and after that, the lid member 4 is closed as shown in FIG. 9D.

On the other hand, when the ribbon cassette 26 is taken out, the holding parts 43 of the ribbon cassette 26 are held by both hands and lifted upward. By the lifting, when the ribbon cassette 26 is detached by holding the holding parts 43, the rotation center is changed by the engagement relation between the engagement part 72 on the ribbon cassette 26 side and the engaged part 71 on the bearing member 50 side of the main body casing 2. Thus, even when the opening angle of the lid member 4 with respect to the opening 2A of the main body casing 2 is small, the ribbon cassette can be detached easily.

Figure 10B:
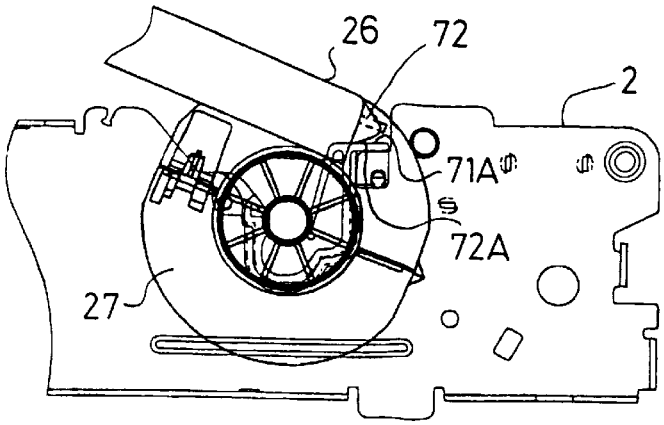
Figure 10C:
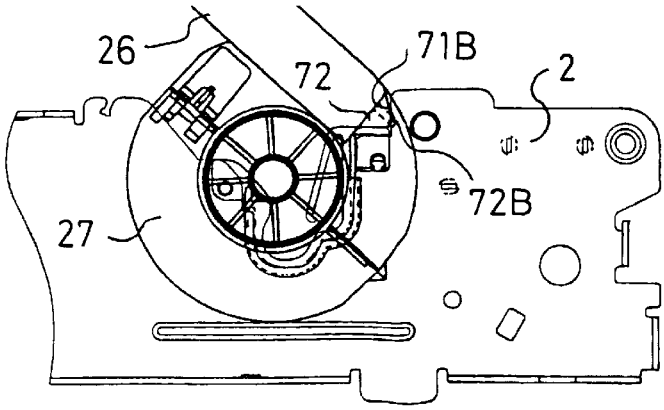
Figure 11:
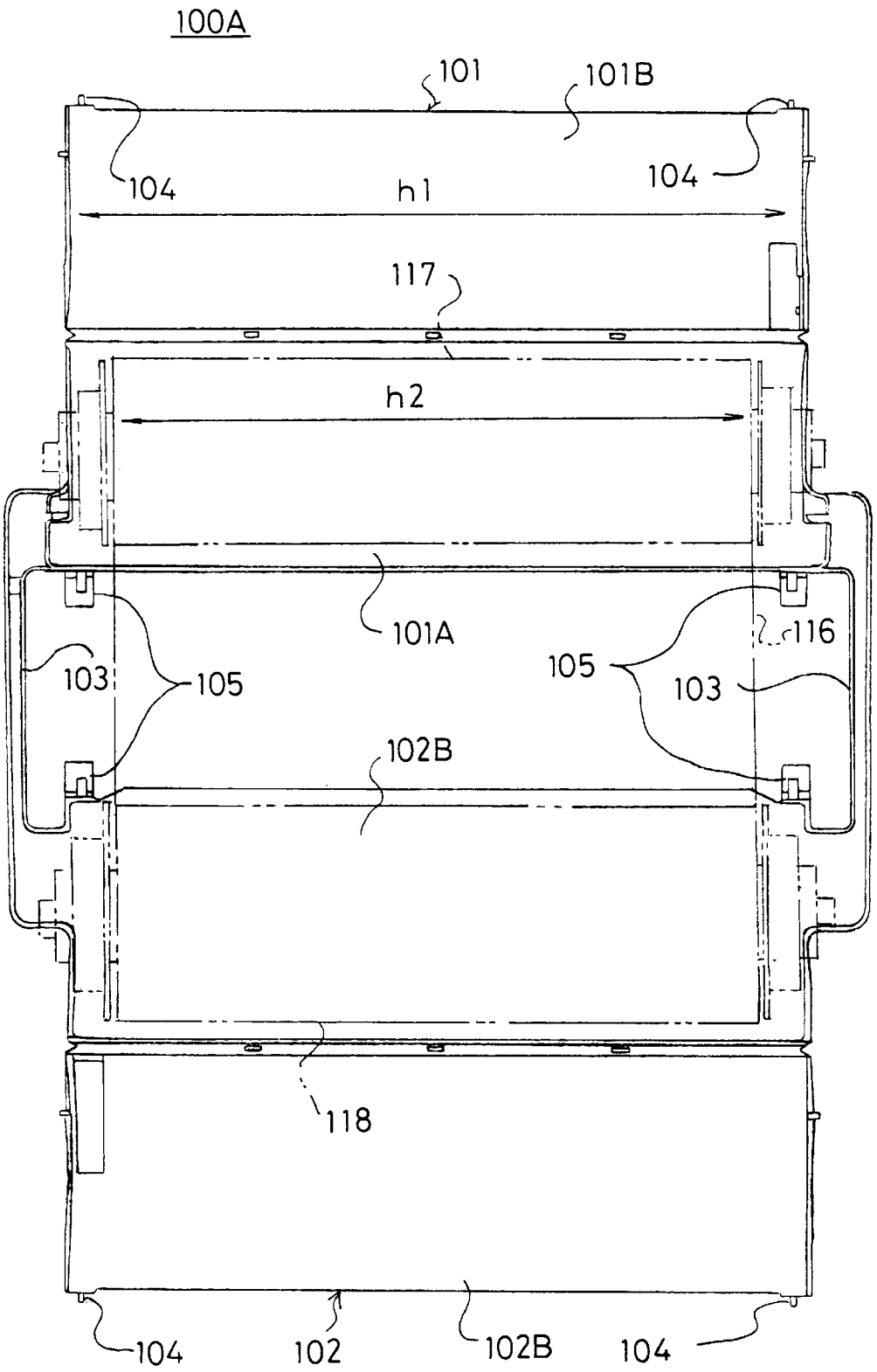
Fig.11 PRIOR ART
FIG. 11 is a plan view of a conventional ribbon cassette in a state where a lid member is open.
Figure 12:
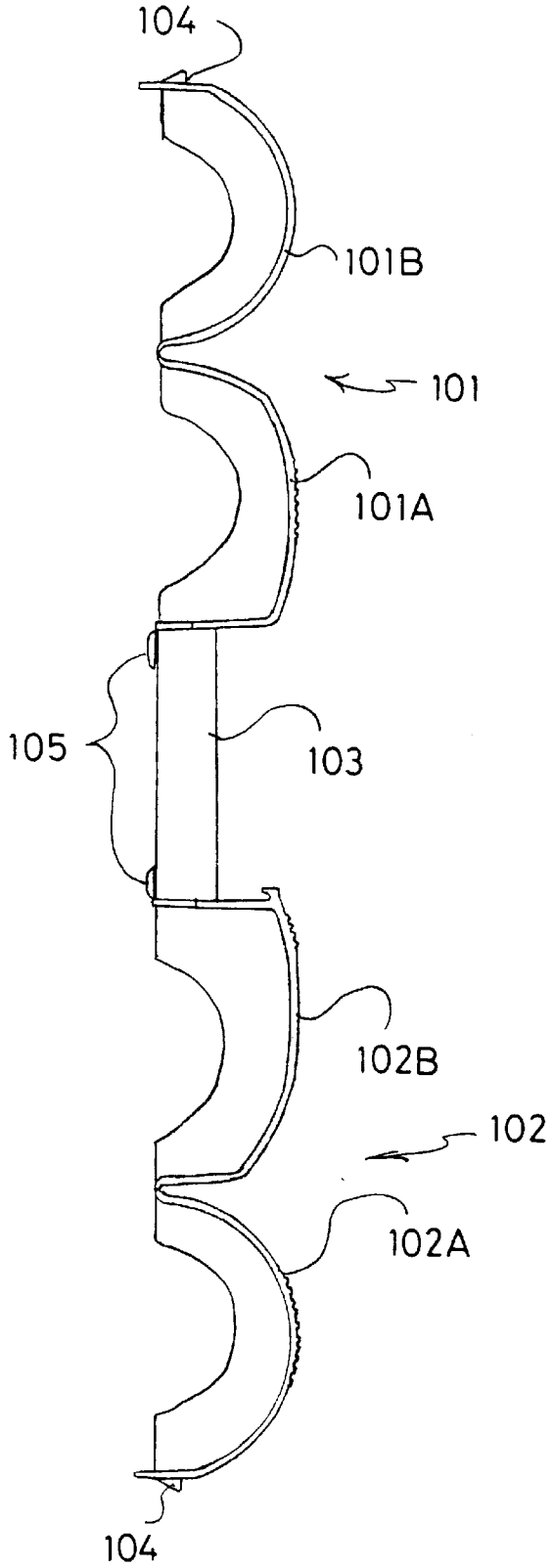
Fig.12 PRIOR ART
FIG. 12 is a central longitudinal section of the same.
Figure 13A:
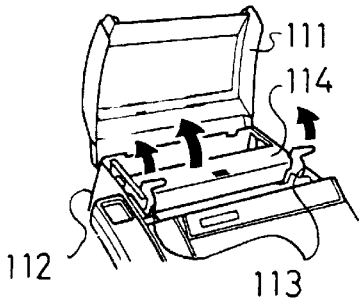
Fig.13A PRIOR ART
FIGS. 13A–E are diagrams explaining a procedure for loading a conventional ribbon cassette.
Figure 13B:
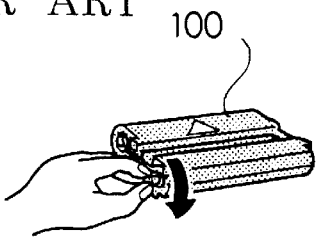
Fig.13B PRIOR ART
Figure 13C:
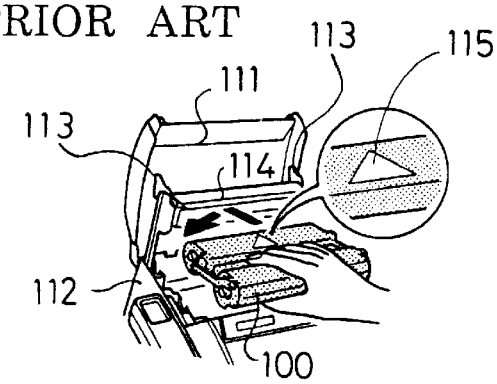
Fig.13C PRIOR ART
Figure 13D:
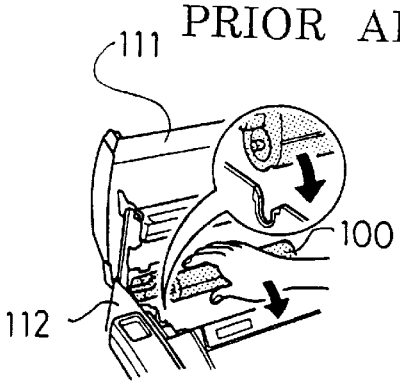
Fig.13D PRIOR ART
Figure 13E:
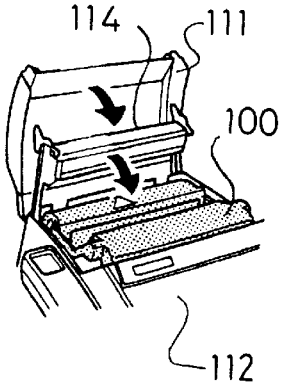
Fig.13E PRIOR ART

That is, when the holding parts 43 of the ribbon cassette 26 are held and the ribbon take-up part 28 side is lifted upward, as it is changed from the state shown in FIG. 10A to FIG. 10B, the engagement part 72 is climbed on the first engaged face 71A of the engaged part 71 and the rotation center of the ribbon cassette 26 is changed from the roll axis of the supply roll 44 to the part in which the first engagement face 72A of the engaged part 72 and the first engagement face 71A of the engaged part 71 are in contact. Even if the opening angle of the lid member 4 is small, the ribbon cassette 26 is largely risen and is easily ejected. Further, when the ribbon take-up part 29 side is lifted, as shown in FIG. 10C, the second engagement face 72B of the engagement part 72 comes into contact with the second engaged face 71B of the engaged part 71 and the rotation center of the ribbon cassette 26 is changed to the contacting part of them. The ribbon cassette 26 is largely risen and is ejected more easily.

By constructing as mentioned above, since the holding parts 43 are projectingly provided on the connecting parts 29, 30 for connecting the ribbon supplying part 27 and the ribbon take-up part 28 by holding the holding parts 43 with both hands, the cassette can be easily attached or detached without acting an unnatural force such as a torsion force or the like to the ribbon cassette 26. Thus, the lid members 27B, 28B for the ribbon supplying part 27 and the ribbon take-up part 28 are not abruptly opened when the ribbon cassette 26 is attached or detached.

Moreover, since such holding parts 43 are provided near the ribbon take-up part 28, the ribbon cassette 26 is attached or detached by holding the holding parts 43 positioning near the ribbon take-up part 28 which is relatively heavy, so that the operations can be stably performed.

Especially, since such holding parts 43 are arranged away from both the ribbon supplying part 27 and the hinge member 23, and the ribbon take-up part 28 is positioned on the side far from the hinge member 23, the ribbon cassette 26 can be easily attached or detached to/from the facsimile apparatus 1 by holding the holding parts 43 irrespective of the opening state of the lid member 4. Consequently, in case of a layout in which the ribbon supplying part of the ribbon cassette is positioned on the side far from the hinge member 23 for opening and closing the main body casing with the lid member in a manner different from the foregoing example, it is desirable to provide holding parts as mentioned above near the ribbon supplying part.

Further, by holding and lifting the holding parts 43 with both hands, the rotation center for ejecting the cassette is formed by the engagement relation between the first engaged face 71A of the engagement part 71 on the main body casing 2 side and the first engaged face 71A of the engagement part 71 of the ribbon cassette 26. Consequently, the cassette can be easily ejected.

In addition, another rotation center for cassette ejection is formed by the engagement relation between the second engaged face 71B of the engaged part 71 on the main body casing 2 side and the second engagement face 72B of the engagement part 72 of the ribbon cassette 26. Even in a case where rotation with respect to the rotation center for cassette ejection formed by the engagement relation between the first engaged face 71A on the main body casing 2 side and the first engagement face 72A on the ribbon cassette 26 side is insufficient, the rotation around another rotation center for cassette ejection is performed, so that the ribbon cassette 26 can be certainly ejected.

Although the example of applying the invention to the facsimile apparatus has been described in the foregoing embodiment, the invention is not limited to the above. The invention can be also similarly applied to a printing apparatus which does not have an original reading function but has a recording medium housing part and a recording medium conveying part for ejecting a recording medium from the recording medium housing part and conveying via a print part to an ejecting part for ejecting the printed recording medium.

What is claimed is:

1. A ribbon cassette comprising a ribbon supplying part for supplying an ink ribbon, a ribbon take-up part for taking up the ink ribbon, and a connecting part for connecting the supplying and take-up parts, each of the supplying and take-up parts comprising a main body and a lid member hingedly connected to the main body, each lid member and main body forming a bearing surface therebetween, wherein the connecting part is provided with projecting holding parts extending upwardly away from the take-up part, said projecting holding parts being substantially contained within a plane defined by the connecting part and aligned with and adjacent to the bearing surface between the lid member and the main body of the take-up part.

2. A printing apparatus comprising:

a main body casing having an opening in which a recording head is provided and a lid member selectively opens and closes the opening of the main body casing; and a ribbon cassette including a ribbon supplying part for supplying an ink ribbon, a ribbon take-up part for taking up the ink ribbon, and a connecting part for connecting the supplying and take-up parts, wherein the connecting part is attached to uppermost portions of the supplying and take-up parts substantially aligned with and above bearing surfaces formed as part of the supplying and take-up parts, the connecting part being provided with projecting holding parts substantially contained within a plane defined by the connecting part and aligned with and adjacent to the bearing surfaces of the take-up part, and wherein the ribbon cassette is detachably attached in the main body casing through the opening in correspondence to the recording head.

3. A facsimile apparatus comprising:

a reception buffer for storing received reception image information; and recording means including a recording head having a plurality of heater elements arranged in a line and to record reception image information onto a recording medium via an ink ribbon having a width substantially equal to a recording area width of the recording head, wherein the recording means includes a printing apparatus comprising:

a main body casing having an opening in which the recording head is provided and a lid member selectively opens and closes the opening of the main body casing, and a ribbon cassette including a ribbon supplying part for supplying an ink ribbon, a ribbon take-up part for taking up the ink ribbon, and a connecting part for connecting the supplying and take-up parts, wherein the connecting part is substantially aligned with and above bearing surfaces formed as part of the supplying and take-up parts, the connecting part being provided with projecting holding parts substantially contained within a plane defined by the connecting part and aligned with and adjacent to the bearing surface of the take-up part, and wherein the ribbon cassette is detachably attached in the main body casing through the opening in correspondence to the recording head.

4. A printing apparatus comprising:

a main body casing having an opening in which a recording head is provided and a lid member for selectively opening and closing the opening of the main body casing; and a ribbon cassette including a ribbon supplying part that supplies an ink ribbon, a ribbon take-up part that takes up the ink ribbon, and a connecting part that connects the ribbon supplying part and the ribbon take-up part, the ribbon supplying part including a ribbon supplying part main body and the ribbon take-up part including a ribbon take-up part main body, wherein the connecting part is provided with a projecting holding part extending above said ribbon take-up part main body, the ribbon cassette is detachably attached in the main body casing through the opening in correspondence to the recording head, and the holding part is grasped to cause the ribbon cassette to rotate about an offset rotation center adjacent to a supply roll axis defined by the ribbon supplying part main body to cause leveraged movement of the ribbon supplying part main body when the ribbon cassette is ejected from or installed in the printing apparatus.

5. A ribbon cassette comprising:

a ribbon supplying part that supplies an ink ribbon;

a ribbon take-up part that takes up the ink ribbon;

at least one connecting part that connects the ribbon supplying part and the ribbon take-up part;

a holding part for each said at least one connecting part, each said holding part being adjacent to and extending above said ribbon take-up part;

an engagement part provided on the at least one connecting part adjacent the ribbon supplying part, said engagement part being positioned at one edge of the cassette, remote from the ribbon take-up part and forming a rotation center about which said ribbon cassette is rotated when the ribbon cassette is ejected from or installed into a recording apparatus; and a supply roll positioned within the ribbon supplying part and a take-up roll positioned within the ribbon take-up part, each said holding portion being axially spaced from and substantially aligned with an axis of the take-up roll.

6. A ribbon cassette comprising:

a ribbon supplying part that defines a supply roll axis;

a ribbon take-up part that defines a take-up roll axis;

an ink ribbon between the ribbon take-up and supplying parts, the ink ribbon defining an ink ribbon plane between the ribbon take-up and supplying parts;

a connecting part that connects the ribbon take-up part and the ribbon supplying part; and at least one holding part that extends upwardly above one of the ribbon take-up part and the ribbon supplying part, the at least one holding part being substantially aligned with one of the supply roll axis and the take-up roll axis, said at least one holding part defining a plane that is substantially perpendicular to the ink ribbon plane.

7. The ribbon cassette according to claim 6, wherein the at least one holding part comprises two holding parts positioned at opposite ends of one of the ribbon supplying part and the ribbon take-up part.

8. The ribbon cassette according to claim 6, wherein the plane of the at least one holding part is substantially perpendicular to one of the supply roll axis and the take-up roll axis.

9. In combination with a printing device, a ribbon cassette comprising:

a ribbon supplying part that supplies an ink ribbon;

a ribbon take-up part that takes up the ink ribbon; and a connecting part that connects the supplying and take-up parts, the ribbon cassette being detachably installed in the printing device, the connecting part further comprising an engagement part provided adjacent one of the ribbon supplying part and the ribbon take-up part, the engagement part being engageable with an engaged part provided in the printing device to shift a rotation center of the ribbon cassette from a selected axis of one of a supply roll axis and a take-up roll axis to a position on an axis of the engagement part when the ribbon cassette is installed in or ejected from the printing device.

10. The combination according to claim 9, wherein said engagement part has a first engagement part and a second engagement part and said engaged part has a first engaged part and a second engaged part, and each of said first and second engagement parts and said first and second engaged parts has a face, the face of the first engagement part coming into contact with the face of the first engaged part to form a first center of rotation for the ribbon cassette, and the face of the second engagement part coming into contact with the face of the second engaged part when the ribbon cassette is installed in or ejected from the printing device to form a second center of rotation for the ribbon cassette.

11. A ribbon cassette comprising:

a ribbon supplying part that supplies an ink ribbon and defines a supply roll axis;

a ribbon take-up part that takes up the ink ribbon and defines a take-up roll axis; and a connecting part that connects the supplying and take-up parts, the ribbon cassette being detachably installed in a printing device, the connecting part further comprising an engagement part provided adjacent one of the ribbon supplying part and the ribbon take-up part, the engagement part being engageable with an engaged part provided in the printing device to form a rotation center for the ribbon cassette when the ribbon cassette is installed in or ejected from the printing device, the rotation center being offset from both the supply roll axis and the take-up roll axis to an axis of the engagement part.

12. The ribbon cassette according to claim 11, wherein said engagement part has a first engagement part and a second engagement part and said engaged part has a first engaged part and second engaged part, and each of said first and second engagement parts and said first and second engaged parts has a face, and wherein the face of the second engagement part and the face of the second engaged part initially contact each other, and then the face of the first engagement part and the face of the first engaged face contact each other when the ribbon cassette is installed in the printing device.

13. A printing apparatus comprising:

a main body casing having an opening in which a recording head is provided and a lid member selectively opens and closes the opening of the main body casing; and a ribbon cassette including a ribbon supplying part that defines a supply roll axis, a ribbon take-up part that defines a ribbon take-up roll axis, an ink ribbon between the ribbon take-up and supplying parts, the ink ribbon defining an ink ribbon plane between the ribbon take-up roll axis and supply roll axis, a connecting part that connects the ribbon take-up and supplying parts, and at least one holding part that extends upwardly above one of the ribbon take-up part and the ribbon supplying part, the at least one holding part being substantially aligned with one of the supply roll axis and the take-up roll axis, said at least one holding part defining a plane that is substantially perpendicular to the ink ribbon plane, wherein the ribbon cassette is detachably attached to the main body casing through the opening in correspondence to the recording head.

14. A facsimile apparatus comprising:

a reception buffer for storing received reception image information; and recording means including a recording head having a plurality of heater elements arranged in a line and to record image information on to a recording medium via an ink ribbon having a width substantially equal to a recording area width of the recording head, wherein the recording means includes a printing apparatus comprising:

a main body casing having an opening in which the recording head is provided and a lid member selectively opens and closes the opening of the main body casing; and a ribbon cassette including a ribbon supplying part that defines a supply roll axis, a ribbon take-up part that defines a take-up roll axis, the ink ribbon being positioned between the ribbon take-up and supplying parts and defining an ink ribbon plane between the ribbon take-up roll axis and supply roll axis, a connecting part that connects the ribbon take-up and supplying parts and at least one holding part that extends upwardly above one of the ribbon take-up part and the ribbon supplying part, the at least one holding part being substantially aligned with one of the supply roll axis and the take-up roll axis, the at least one holding part defining a plane that is substantially perpendicular to the ink ribbon plane, wherein the ribbon cassette is detachably attached to the main body through the opening in correspondence to the recording head.

15. A ribbon cassette comprising:

a ribbon supplying part that supplies an ink ribbon and defines a supply roll axis;

a ribbon take-up part that takes up the ink ribbon and defines a take-up roll axis; and a connecting part that connects the supplying and take-up parts, the ribbon cassette being detachably installed in a printing device, the connecting part further comprising an engagement part provided adjacent one of the ribbon supplying part and the ribbon take-up part, the engagement part being engageable with an engaged part provided in the printing device to form a rotation center adjacent to a selected axis of one of the supply roll axis and the take-up roll axis, wherein rotation of the ribbon cassette about the rotation center causes leveraged movement of a portion of the ribbon cassette, where the selected axis is positioned, away from the printing device when the ribbon cassette is ejected from the printing device.

16. The ribbon cassette according to claim 15, wherein said engagement part has a first engagement part and a second engagement part.

17. The ribbon cassette according to claim 16, wherein said engaged part has a first engaged part and a second engaged part, and wherein each of said first and second engagement parts and said first and second engaged parts has a face, the face of the first engagement part coming into contact with the face of the first engaged part, and the face of the second engagement part coming into contact with the face of the second engaged part when the ribbon cassette is installed in or ejected from the printing device.

18. The ribbon cassette according to claim 17, wherein the face of the first engagement part and the face of the first engaged part initially contact each other, and then the face of the second engagement part and the face of the second engaged part contact each other when the ribbon cassette is ejected from the printing device.

19. The ribbon cassette according to claim 17, wherein the face of the second engagement part and the face of the second engaged part initially contact each other, and then the face of the first engagement part and the face of the first engaged face contact each other when the ribbon cassette is installed in the printing device.

* * * * *